US012799841B2

(12) United States Patent
Glaesman et al.

(10) Patent No.: US 12,799,841 B2
(45) Date of Patent: Nov. 17, 2026

(54) SEAL ENERGIZING SYSTEMS TO MAINTAIN SEAL ENERGIZATION IN A DOWNHOLE WELL AND METHODS TO MAINTAIN SEAL ENERGIZATION IN A DOWNHOLE WELL

(71) Applicant: Halliburton Energy Services, Inc., Houston, TX (US)

(72) Inventors: Chad W. Glaesman, Singapore (SG); Marco Antonio dos Santos Fernandes, Macae (BR)

(73) Assignee: Halliburton Energy Services, Inc., Houston, TX (US)

( * ) Notice: Subject to any disclaimer, the term of this patent is extended or adjusted under 35 U.S.C. 154(b) by 128 days.

(21) Appl. No.: 18/819,906

(22) Filed: Aug. 29, 2024

(65) Prior Publication Data

US 2026/0063013 A1 Mar. 5, 2026

(51) Int. Cl.
*E21B 33/12* (2006.01)
*E21B 33/127* (2006.01)

(52) U.S. Cl.
CPC ..... *E21B 33/1272* (2013.01)

(58) Field of Classification Search
CPC ..... E21B 17/028; E21B 17/0283; E21B 17/0285; E21B 17/206; E21B 2200/01; E21B 33/12; F16L 17/00; F16L 17/02; F16L 17/10
See application file for complete search history.

(56) References Cited

U.S. PATENT DOCUMENTS 3,600,010 A * 8/1971 Downs, III ..... F16L 19/08 285/321
3,653,671 A * 4/1972 Shipes ..... E21B 33/128 277/328
3,799,585 A * 3/1974 Frost ..... F16L 27/0828 285/93
4,328,873 A * 5/1982 Gonzalez ..... E21B 10/24 175/228
6,161,834 A * 12/2000 Pollack ..... F16L 17/10 277/560
8,544,265 B2 10/2013 Chandler
10,077,616 B2 9/2018 Stachowiak, Jr.
(Continued)

FOREIGN PATENT DOCUMENTS

FR 2623570 A1 5/1989
SK 142005 A3 9/2006

OTHER PUBLICATIONS

International Search Report and Written Opinion mailed May 21, 2025 in PCT/US2024/046760.

*Primary Examiner* — Kipp C Wallace
(74) *Attorney, Agent, or Firm* — The Hilton Firm PLLC

(57) ABSTRACT

A seal energizing system to maintain seal energization in a well includes a connector body disposed adjacent a tubular body, the tubular body and connector body forming an inner chamber, the inner chamber isolated from an outer chamber by a seal positioned between the tubular body and the connector body. The system further includes a piston movable relative to the connector body. The piston includes a first piston surface exposed to a fluid of the outer chamber and a second piston surface exposed to fluid of the inner chamber. The first piston surface includes a surface area greater than that of the second piston surface.

20 Claims, 9 Drawing Sheets

(56) References Cited

U.S. PATENT DOCUMENTS

| | | | | |
|---|---|---|---|---|
| 2003/0098064 | A1 | 5/2003 | Kohli et al. | |
| 2005/0230122 | A1* | 10/2005 | Cho | E21B 23/042 166/381 |
| 2006/0144622 | A1* | 7/2006 | Bailey | E21B 47/10 175/230 |
| 2007/0056749 | A1* | 3/2007 | Gambier | E21B 33/127 166/387 |
| 2007/0125532 | A1 | 6/2007 | Murray et al. | |
| 2011/0126912 | A1* | 6/2011 | Grimseth | E21B 33/0355 137/554 |
| 2012/0216889 | A1* | 8/2012 | Eide | F15B 1/024 137/565.01 |
| 2012/0273055 | A1* | 11/2012 | Lirette | F16K 17/046 137/515 |
| 2013/0014959 | A1 | 1/2013 | Tips et al. | |
| 2015/0308253 | A1* | 10/2015 | Clark | E21B 33/02 175/24 |
| 2024/0247561 | A1 | 7/2024 | Angstmann et al. | |

* cited by examiner

SEAL ENERGIZING SYSTEMS TO MAINTAIN SEAL ENERGIZATION IN A DOWNHOLE WELL AND METHODS TO MAINTAIN SEAL ENERGIZATION IN A DOWNHOLE WELL

TECHNICAL FIELD

The present disclosure relates generally to sealing systems for downhole subterranean wells, and more particularly to systems and methods to energize seals in a downhole to well to improve sealing performance.

BACKGROUND

In certain hydrocarbon-bearing subterranean wells where high environmental pressures are expected, it is often beneficial for mechanical systems to be pressure balanced to minimize excessive component deflection and lower fatigue risk for downhole components. In some cases, most notably those isolating electrical connections, these systems only function when isolation is maintained in the electrical chamber while still allowing pressure balance against the external environment. Many seal designs for radial sealing orientations are pressure energized and therefore achieve their maximum sealing performance when subjected to differential pressures. Isolation of protected chambers or spaces becomes increasingly difficult under balanced conditions since the desired differential pressure is not present. Instead, the initial "squeeze" and deformation of the seal is the dominant source of contact stress. These seals in a balanced pressure condition may further by challenged to isolate when in a high pressure and low temperature environment, which results in the sealing material's minimum volume condition. Sealing materials having high coefficient of thermal expansion (CTE) and low bulk modulus (K) values are even more sensitive to these conditions.

BRIEF DESCRIPTION OF THE DRAWINGS

Illustrative examples of the present disclosure are described in detail below with reference to the attached drawing figures, which are incorporated by reference herein, and wherein.

Figure 1:
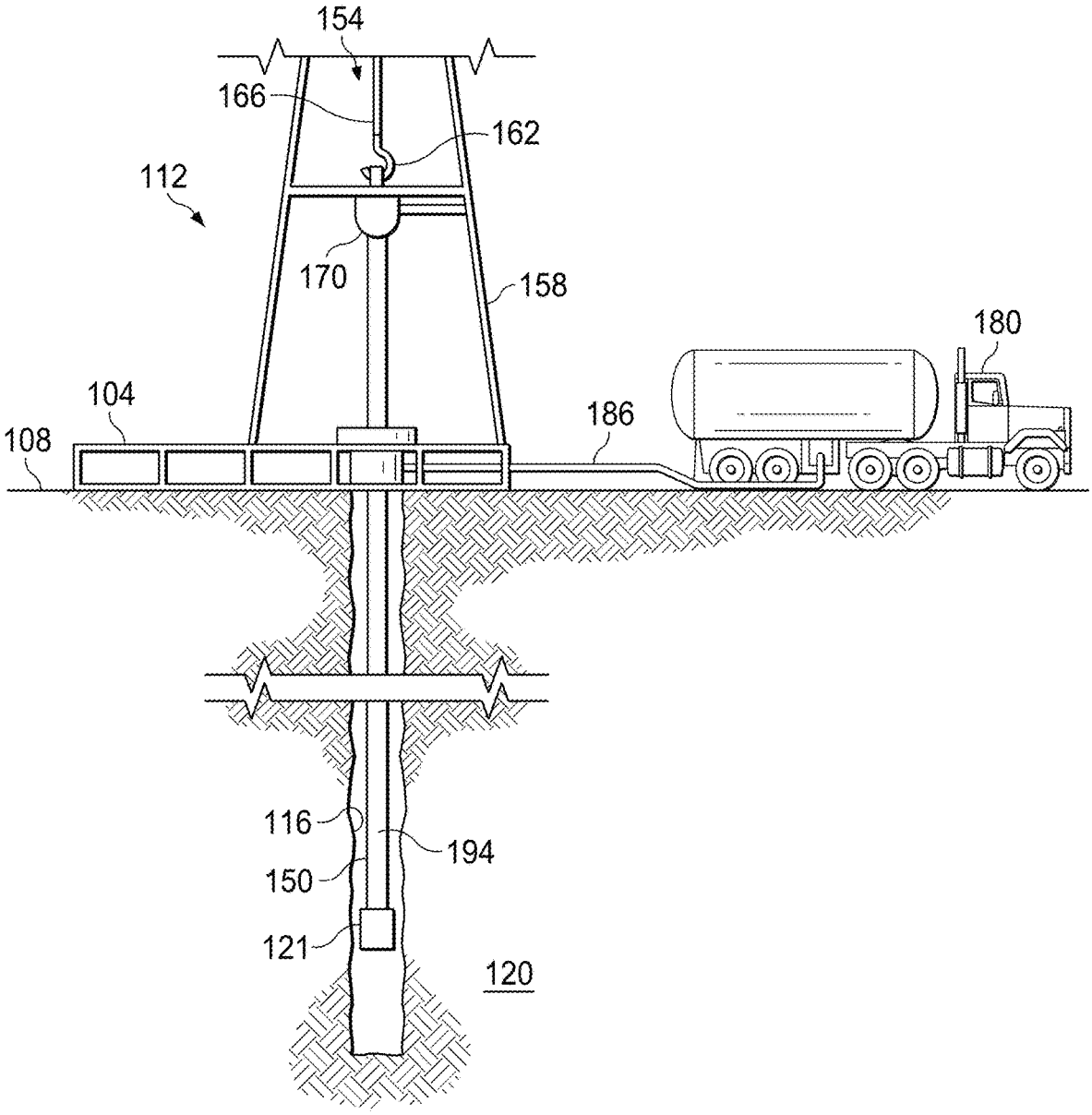
FIG. 1 is a schematic view of an on-shore well having a seal energizing system deployed in a wellbore according to an embodiment.

The illustrated figures are only exemplary and are not intended to assert or imply any limitation with regard to the environment, architecture, design, or process in which the different examples may be implemented.

DETAILED DESCRIPTION

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The present disclosure relates generally to a system and method to energize a seal in a downhole pressure balanced well system. Often during certain well conditions, the pressures and temperatures downhole can affect deformable seals or other sealing elements that protect isolated chambers or reservoirs. Fluids within these protected spaces, when exposed to certain temperature or pressure changes relative to the conditions at which the spaces were sealed results in a change in the pressures within the space, and in some instances the fluid pressure within these spaces may approach or equal the pressure of wellbore fluids outside of the protected space. When this occurs, a balanced pressure situation occurs where the pressure of the two fluids influencing the seal become approximately equal (or balanced), and the seal may not continue to maintain a good seal against its sealing surface. Such a balanced pressure scenario results in poor sealing and often will result in the protected space being invaded by fluid from outside the space, such as by wellbore fluid.

In some embodiments, the protected space may provide a sealed environment for a dielectric fluid that protects an electrical connection between two or more components. If wellbore fluid invades the space and mixes with or replaces the dielectric fluid, voltage across the electrical connection may be lost due to the presence of the conductive wellbore fluid. In other embodiments, the protected space may house mechanical, electrical or structural components that are sensitive to corrosion and need to be protected from corrosive fluids in the wellbore. It is essential to maintain an effective seal and doing so with a traditional sealing element requires maintaining an adequate pressure differential across the seal to ensure that the seal seats properly against a sealing surface.

The systems and methods described herein provide a tubular in which the protected space is housed to contain a fluid that is sealed from contamination by fluids outside of the protected space. A movable piston is positioned within the tubular and includes a first surface area on one side of the piston and a second surface area on an opposite side of the piston. The surface area of the second surface area, which is exposed to fluid in the protected space, is smaller than that of the first surface area. The first surface area is exposed to fluid from outside the protected space, such as wellbore fluid. The smaller second surface area ensures that pressure exerted by the wellbore fluid is amplified by the piston, thereby resulting in a higher pressure in the fluid of the protected space. This higher pressure exerted on the sealing elements from within the protected space reduces the likelihood that wellbore fluids invade the protected space.

Now turning to the figures, FIG. 1 illustrates a schematic view of an on-shore well 112 having a seal energizing system 121 deployed in the well 112. The well 112 includes a wellbore 116 that extends from surface 108 of the well 112 to a subterranean substrate or formation 120. The well 112 and rig 104 are illustrated onshore in FIG. 1, but alternatively, the well could be a subsea well accessed by an off-shore platform (not illustrated).

In the embodiments illustrated in FIG. 1, the wellbore 116 has been formed by a drilling process in which dirt, rock and other subterranean material is removed to create the wellbore 116. During or after the drilling process, a portion of the wellbore 116 may be cased with a casing (not illustrated). In other embodiments, the wellbore 116 may be maintained in an open-hole configuration without casing. The embodiments described herein are applicable to either cased or open-hole configurations of the wellbore 116, or a combination of cased and open-hole configurations in a particular wellbore.

After the drilling of the wellbore 116 is complete and the associated drill bit and drill string are "tripped" from the wellbore 116, a completion string 150 string is lowered into the wellbore 116. In some embodiments, the completion string 150 includes an annulus 194 disposed longitudinally in the completion string 150 that allows fluid flowing from a fluid source 180 (vehicle) on the surface 108 of the well 112 downhole.

The lowering of the completion string 150 may be accomplished by lift assembly 154 associated with a derrick 158 positioned on or adjacent to the rig 104 or offshore platform 132. The lift assembly 154 may include a hook 162, a cable 166, a traveling block (not shown), and a hoist (not shown) that cooperatively work together to lift or lower a swivel 170 that is coupled to an upper end of the completion string 150. Additional sections of the completion string 150 may be added until the completion string 150 is lowered to a desired depth.

Although FIG. 1 illustrates a completion environment, the seal energizing system 121 may also be deployed in various production environments or drilling environments where it is desired to maintain sealing in balanced or near-balanced pressure environments. Further, although FIG. 1 illustrates a single seal energizing system 121, multiple seal energizing systems may be deployed in the well 112. In another one of such embodiments, the wellbore 116 is a multilateral wellbore. In such embodiment, one or more seal energizing systems 121 described herein may be deployed in each lateral wellbore of the multilateral well bore to improve sealing when the pressure of fluid in the wellbore may be at or near a pressure of fluid in an isolated or sealed chamber.

Figure 2:
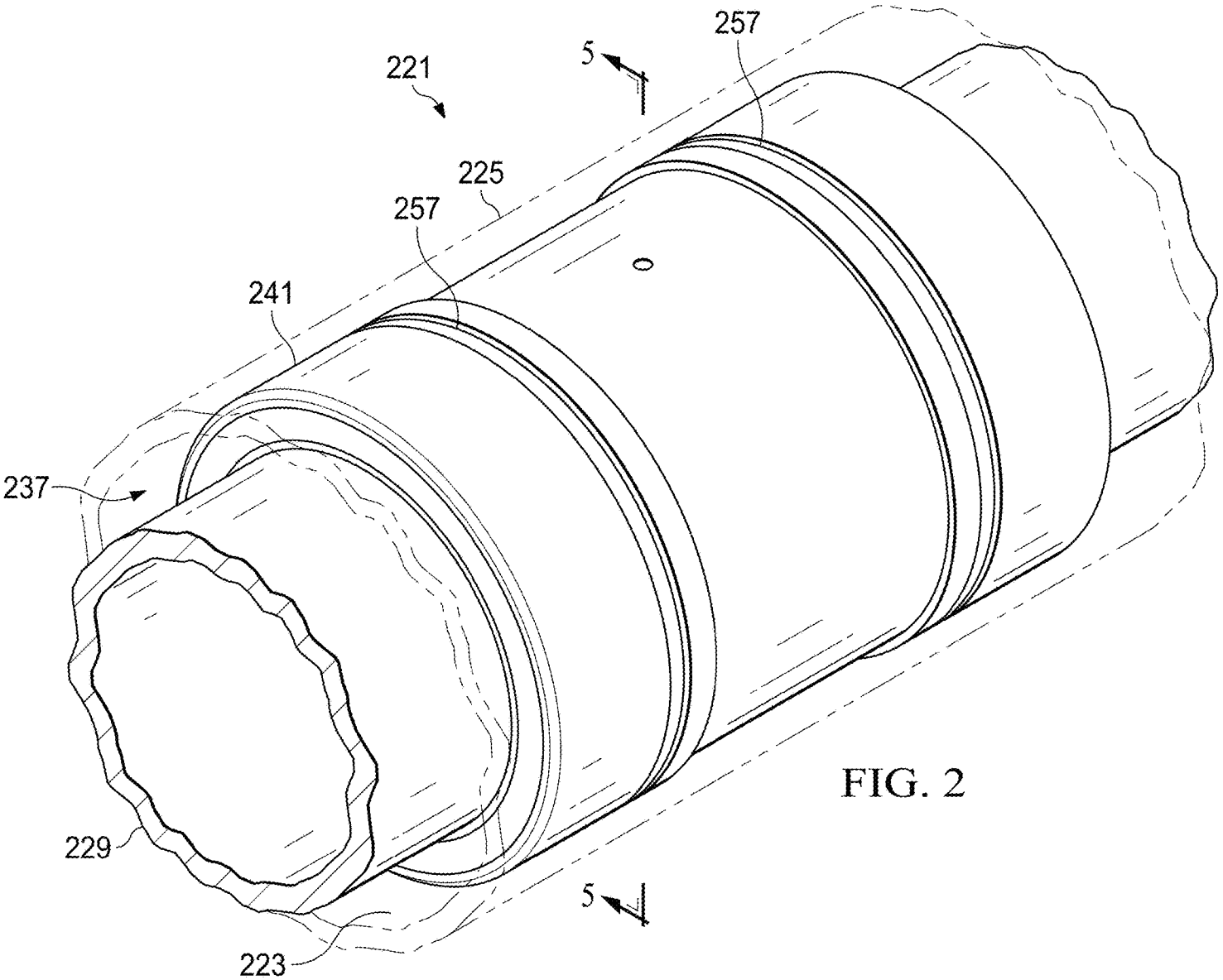
FIG. 2 is an isometric front view of a seal energizing system according to an embodiment.

FIG. 2 illustrates an isometric front view of a seal energizing system 221 according to an embodiment of the disclosure. The seal energizing system 221 is similar to the seal energizing system 121 of FIG. 1 and may be deployed in similar wells or downhole environments. Seal energizing system 221 includes a tubular body 225. An inner tubular 229 is positioned within a passage 233 of the tubular body, and a tubular annulus 237 is formed between the tubular body 225 and the inner tubular 229. A connector body 241 is disposed within the tubular annulus 237. The tubular body 225, inner tubular 229 and connector body 241 each may be elongated and generally cylindrical in shape. In the embodiment illustrated in FIG. 2, the connector body 241 may be shorter than one or both of the tubular body 225 and the inner tubular 229. However, in other embodiments, each of the respective components may be of similar length. In an embodiment, the tubular body 225, inner tubular 229 and connector body 241 may each be made from steel or another rigid material that is suitable for downhole environments. In some embodiments, the components may be made from an electrically insulating material, especially when electrical connections may be made in close proximity to or within the tubular body 225, inner tubular 229 and connector 241.

Figure 3:
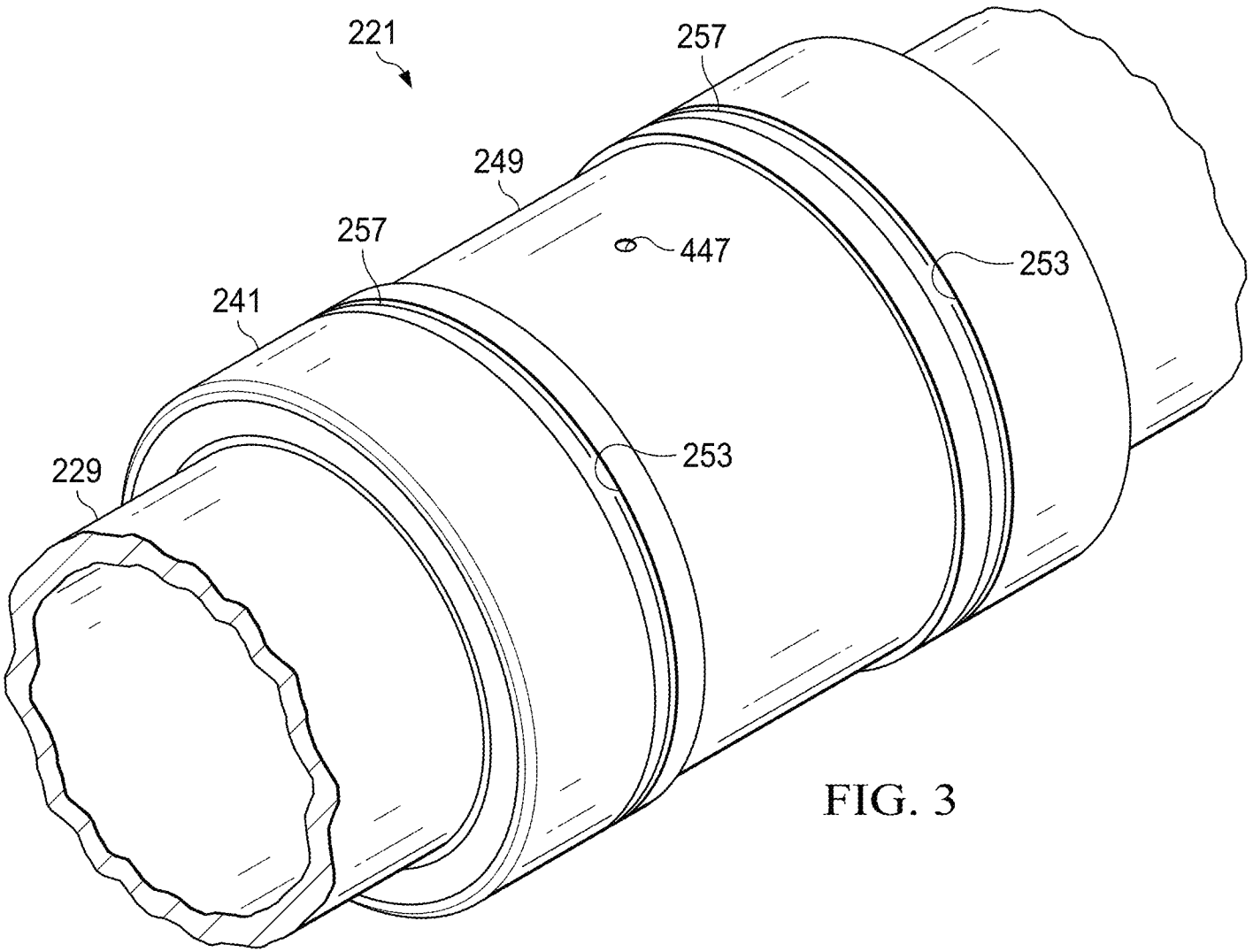
FIG. 3 is an isometric front view of the seal energizing system of FIG. 2 illustrated with a tubular body removed from the seal energizing system.

Referring to FIG. 3, an isometric front view of the seal energizing system 221 is illustrated with the tubular body 225 removed. In the illustrated embodiment, the connector body 241 includes a recessed portion 249 on an exterior surface of the connector body 241 and preferably extending circumferentially around the connector body 241. A pair of seal recesses 253 are also disposed on the exterior surface of the connector body 241, and each receives a seal 257 to provide sealing between the connector body 241 and tubular body 225. In an embodiment, the seals 257 may be flexible and made from an elastomeric material. The seals 257 preferably are circular in cross-section, such as an "o-ring," and extend circumferentially and continuously around the connector body 241. In other embodiments, the seals may have cross-sectional shapes that are oval, elliptical or other shapes. When positioned within the seal recess 253, the seal 257 may be of a height (i.e., diameter for a seal 257 that is round in cross-sectional shape) that is greater than a depth of the seal recess 253 to improve sealing between the connector body 241 and the tubular body 225.

Figure 4:
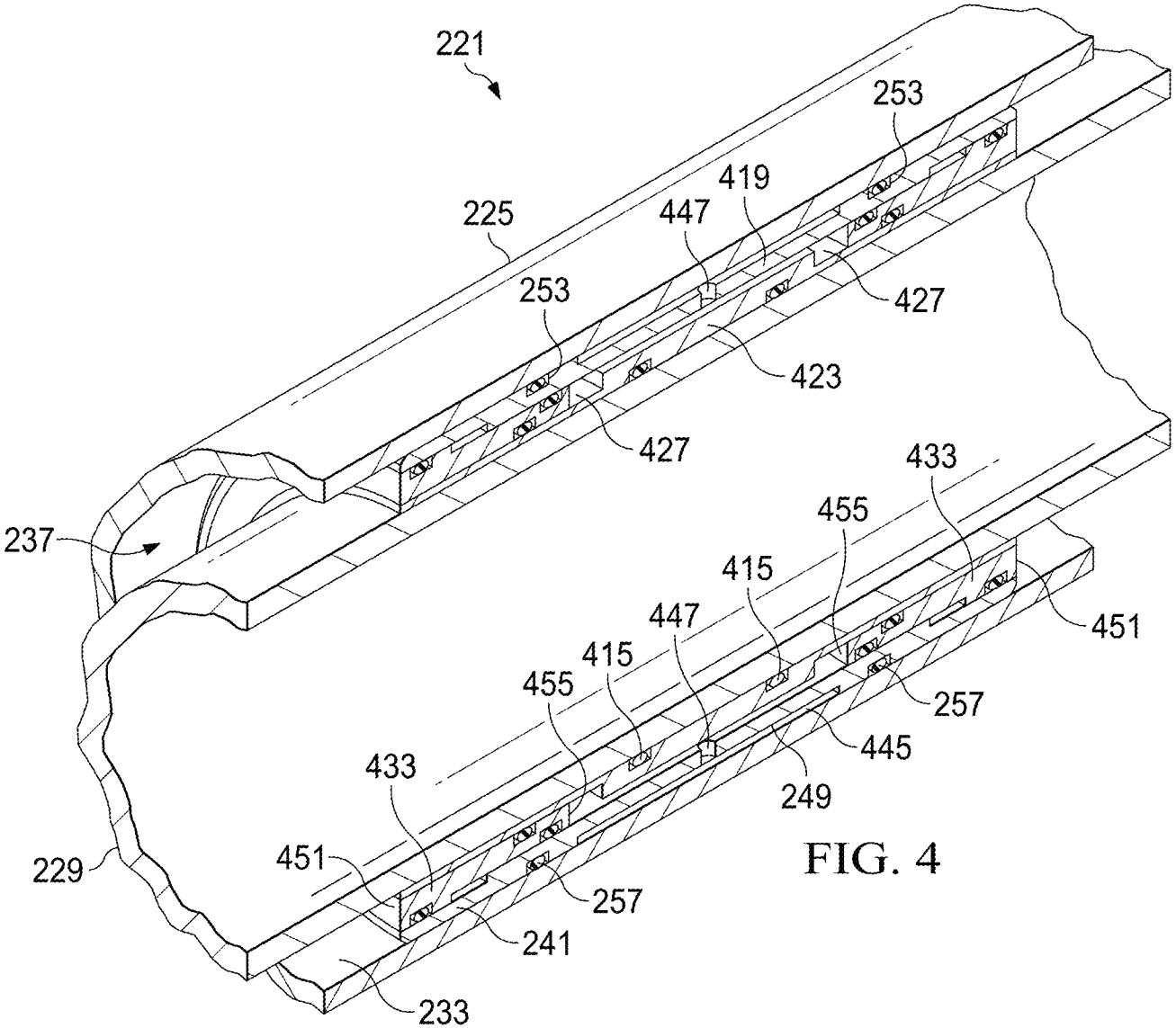
FIG. 4 is an isometric, cross-sectional view of the seal energizing system of FIG. 2.
Figure 5:
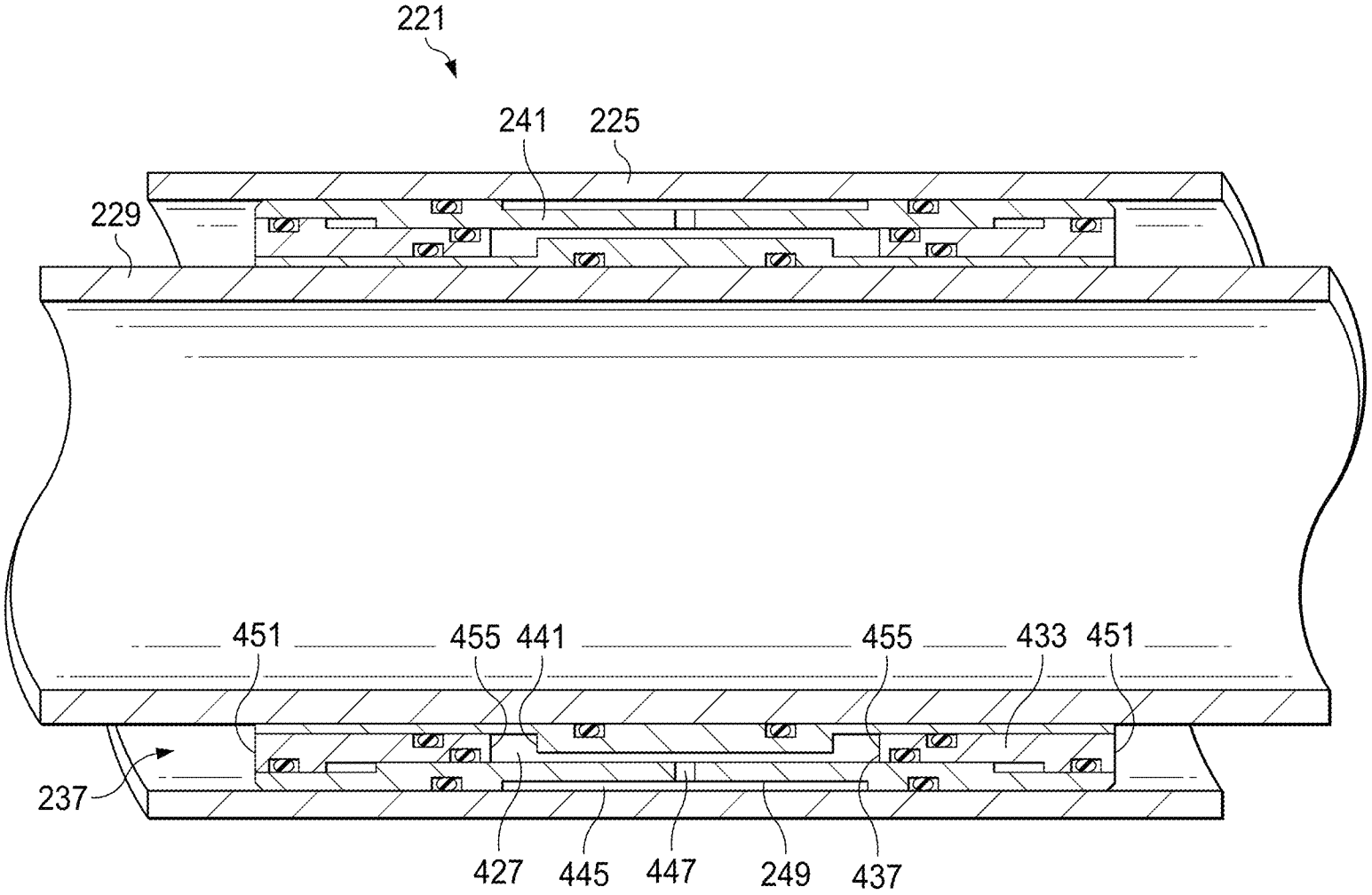
FIG. 5 is a cross-sectional side view of the seal energizing system of FIG. 2 taken at 5-5.

FIG. 4 illustrates an isometric, cross-sectional view of the seal energizing system 221, and FIG. 5 illustrates a cross-sectional side view of the seal energizing system 221 taken at 5-5. FIGS. 4 and 5 depict the connector body 241 within the tubular annulus 237 formed between the tubular body 225 and the inner tubular 229. The connector body 241 is sealed against the tubular body 225 by the seals 257, and the connector body may also be sealed against the inner tubular 229 by seals 415 positioned in seal recesses formed on an inner surface of the connector body 241.

The connector body 241 includes an outer body member 419 and an inner body member 423 that may be coupled together via an integral or rigid connection such as welding or use of fasteners, pins, or other attachment methods. Alternatively, the outer body member 419 and inner body member 423 may not be coupled but may be secured relative to one another to prevent relative movement between the outer body member 419 and inner body member 423. A connector annulus 427 is formed between the outer body member 419 and inner body member 423. In the embodiment illustrated in FIGS. 4 and 5, a piston 433 is slidingly received within the connector annulus 427 of the connector body 241. Like the connector body 241, each piston 433 is preferably generally cylindrical in shape to allow for close engagement between movable pistons 433 and the connector body 241. One or more seals are provided on inner and outer circumferential surfaces of the piston 433 to seal between the piston 433 and the connector body 241.

Each piston 433 includes a shoulder 437 that is capable of engaging a corresponding shoulder 441 on the connector body 241 (either the outer body member 419 or the inner body member 423). The shoulders 437, 441 limit inward travel of the piston 433 into the connector annulus 427. Similarly, although not illustrated, a shoulder may be provided on either the piston 433 or the connector body 241 to limit outward travel of the piston 433.

An inner chamber 445 is formed within the recessed portion 249 of the connector body 241 between the connector body 241 and the tubular body 225 and further extends to the gap between the outer body member 419 and inner body member 423, which is located between the pistons 433. One or more apertures 447 in the outer body member 419 allows fluid communication between the bifurcated compartments of the inner chamber.

Each piston 433 includes a first end of the piston 433 with a first piston surface 451 and a second, opposite end of the piston with a second piston surface 455. Each of the piston surfaces 451, 455 are capable of bearing any forces imposed by the fluid adjacent the respective piston surfaces 451, 455. The first piston surface 451 faces outward toward an end of the connector body 241 and is exposed to a fluid of the tubular annulus 237. In an embodiment, the fluid present in the tubular annulus 237 is a wellbore fluid. The second piston surface 455 is opposite the first piston surface 451, faces inward, and is exposed to a fluid of the inner chamber 445. The inner chamber 455 is sealed as described herein to prevent fluids the tubular annulus 237 from invading or entering the inner chamber 455. The fluid in the inner chamber 445 may include a liquid, agas or even a gel such as an organic, dielectric gel. In an embodiment, the fluid in the inner chamber may be a different fluid from the fluid present in the tubular annulus 237. Examples of fluid that may be contained in the inner chamber include dielectric fluids such as silicone oils, mineral oils, esters, or other oil-based organic compounds. Silicone oils may be preferred in some embodiments because the silicone oils offer some compressibility which is desirable in the piston-balanced system described herein.

In an embodiment, the first piston surface 451 of each piston 433 has a surface area greater than that of the second piston surface 455. In a balanced state, the piston 433 has an equal force acting on both the first and second end of the piston. Since the fluid in the inner chamber 455 is isolated and due to the smaller surface area of the second piston surface 455, the pressure of the fluid in the inner chamber 455 will remain greater than the pressure of fluid in the tubular annulus 237. This is due to the relationship of force, area and pressure given by the formula:

$$F = P * A,$$

where F is the force applied to the piston 433, P is the pressure of fluid, and A is the surface area of the piston 433 to which the force is applied.

Figure 6:
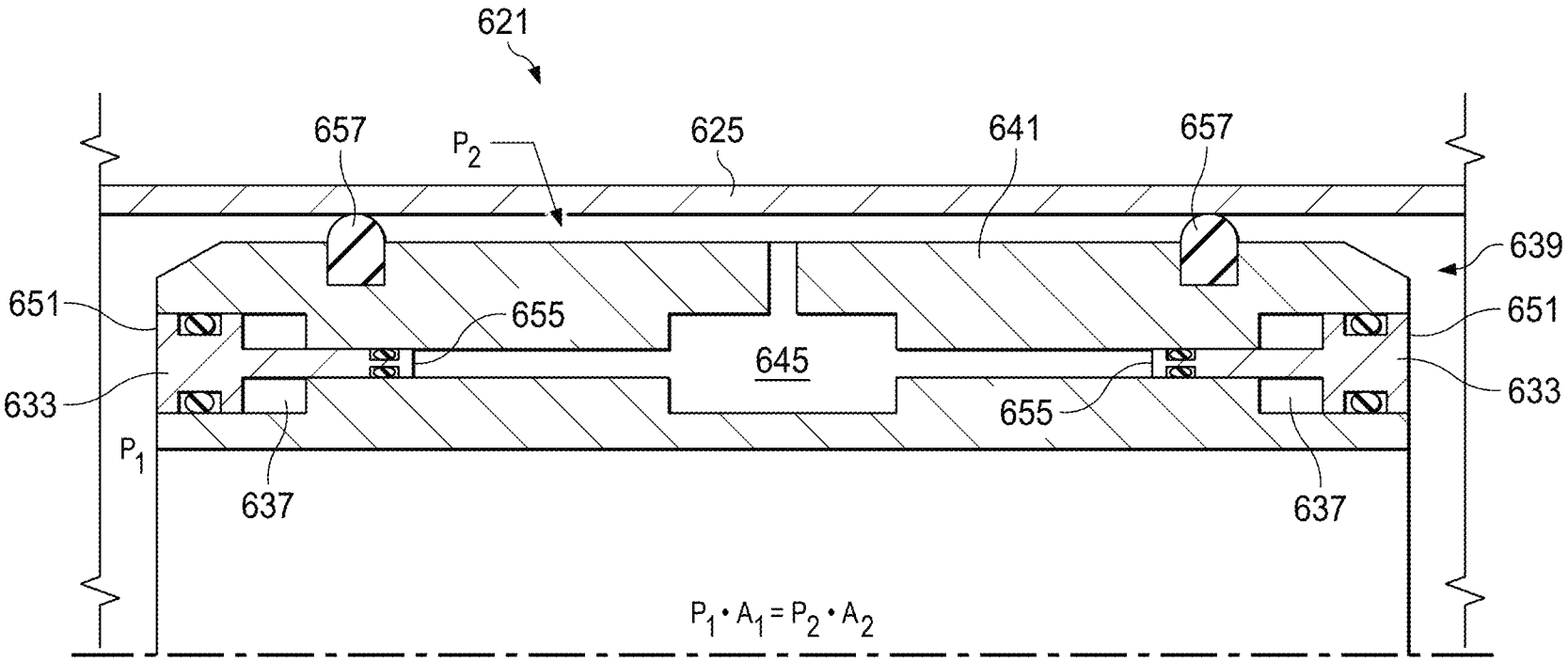
FIG. 6 is a schematic of a seal energizing system according to an embodiment.

FIG. 6 illustrates a schematic of a seal energizing system 621 according to an embodiment of the disclosure. The seal energizing system 621 is similar to seal energizing system 221 and includes a pair of pistons 633, each piston 633 disposed in a connector annulus 637 of a connector body 641. The connector body 641 further includes an inner chamber 645. The connector body 641 is sealed against a tubular body 625 by seals 657 similar to the seals 257 illustrated in FIGS. 2-5. Pistons 633 are also sealed by seals against the connector body 641 to prevent ingress of fluid from outside the connector body 641 into the inner chamber 645.

While dual pistons are illustrated in FIG. 6, in an embodiment, the seal energizing system 621 may include only a single piston, or instead may include more than two pistons. Each piston 633 includes a first end with a first piston surface 651 and a second, opposite end of the piston with a second piston surface 655. Each of the piston surfaces 651, 655 are capable of bearing any forces imposed by the fluid adjacent the respective piston surfaces 651, 655. The first piston surface 651 faces outward toward an end of the connector body 641 and is exposed to a fluid outside of the connector body 641, or within a tubular annulus 639. The fluid present in the tubular annulus 639 may be a wellbore fluid. The second piston surface 655 is opposite the first piston surface 651, faces inward, and is exposed to a fluid of the inner chamber 645, which may be similar to the fluid of inner chamber 445 described above.

The first piston surface 651 of each piston 633 has a surface area greater than that of the second piston surface 655. As illustrated in FIG. 6, the pressure of fluid outside the connector body 641 is referenced as $P_1$, while the pressure of fluid inside the inner chamber 645 is referenced as $P_2$. The surface area of the first piston surface 651 is designated by $A_1$, while the surface area of the second piston surface 655 is designated by $A_2$. In a balanced state, where the force acting on both sides of the piston 633 is equal, the relationship between the surface areas of the piston 633 and the pressures of fluid on each side of the piston are provided by:

$$P1 * A1 = P2 * A2.$$

The formula demonstrates that the pressure, $P_2$, of the fluid in the inner chamber 645 must be greater than the pressure, $P_1$, of the fluid outside the connector body 641, since the area, $A_1$, of the first piston surface 651 is greater than the area, $A_2$, of the second piston surface 655.

Figure 7:
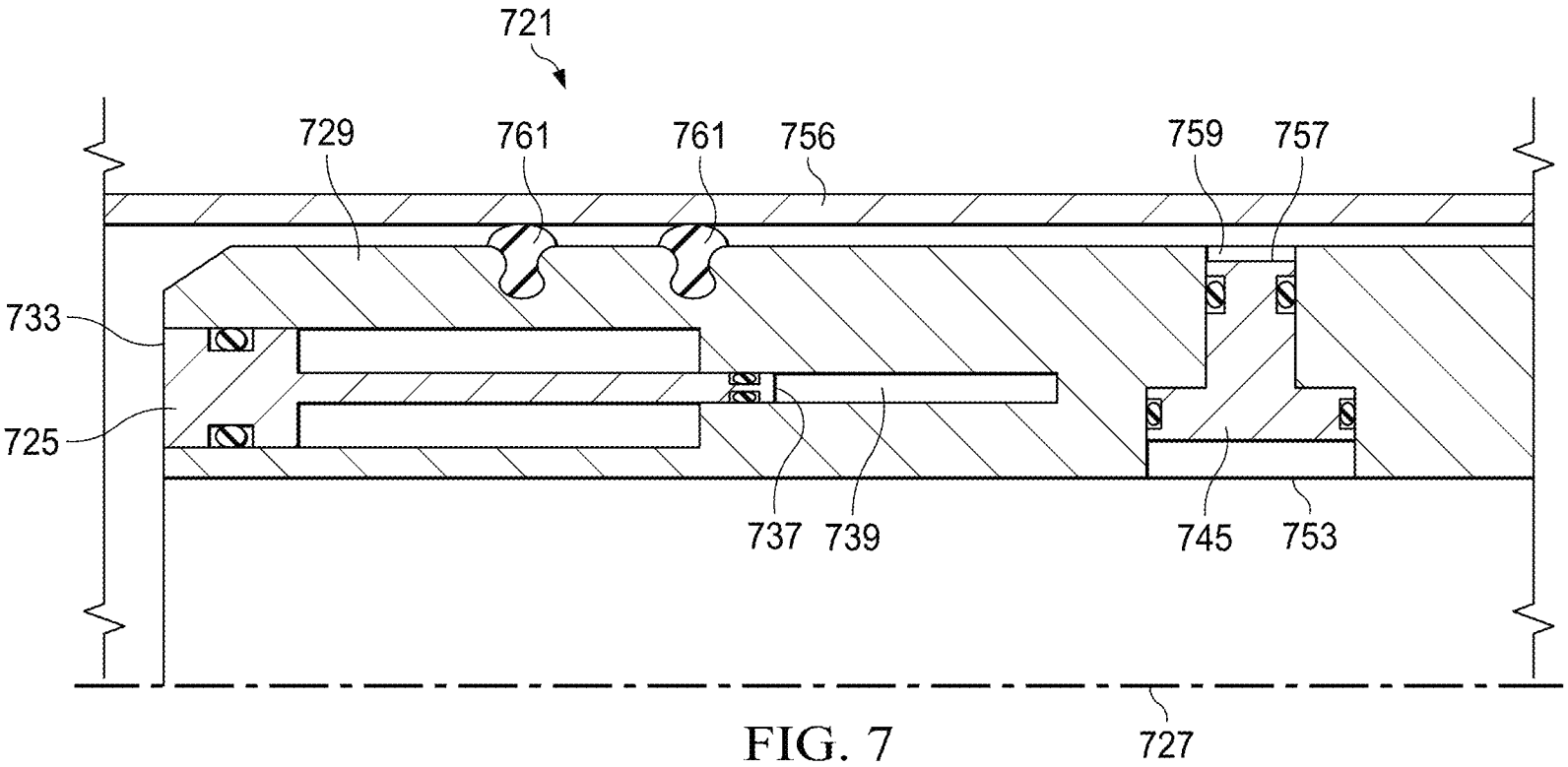
FIG. 7 is a schematic of a seal energizing system according to an embodiment.

FIG. 7 illustrates a schematic of a seal energizing system 721 according to an embodiment of the disclosure. The seal energizing system 721 may include one or more pistons, and schematically illustrated in FIG. 7 are two different piston alternatives. A piston 725 is similar to the piston 633 of FIG. 6. Piston 725 is laterally oriented in line with a longitudinal axis 727 of a connector body 729 in which the piston 725 is received. The piston 725 includes a first end with a first piston surface 733 and a second, opposite end with a second piston surface 737. The first piston surface 733 faces outward toward an end of the connector body 729 and is exposed to a fluid outside of the connector body 729, which may be a wellbore fluid. The second piston surface 737 is opposite the first piston surface 733, faces inward, and is exposed to a fluid of an inner chamber 739, which may be similar to the fluid of inner chambers 445, 645 described above. The first piston surface 733 has a surface area greater than that of the second piston surface 737. The advantages provided by the different surface areas of the piston 725 are similar to those described previously, namely that the pressure of the fluid in the inner chamber is maintained at an amount greater than the pressure of the fluid outside of the connector body 729.

Alternatively, a piston 745 is transversely oriented to the longitudinal axis 727 of the connector body 729. The piston 745 includes a first end with a first piston surface 753 and a second, opposite end with a second piston surface 757. The first piston surface 753 faces radially inward relative to the longitudinal axis 727 of the connector body 729 and is exposed to a fluid adjacent to or outside of the connector body 729, which may be a wellbore fluid. The second piston surface 757 is opposite the first piston surface 753, faces radially outward, and is exposed to a fluid of an inner chamber 759, which may be similar to the fluid of inner chambers 445, 645 described above. The first piston surface 753 has a surface area greater than that of the second piston surface 757. The advantages provided by the different surface areas of the piston 745 are similar to those described previously, namely that the pressure of the fluid in the inner chamber is maintained at an amount greater than the pressure of the fluid adjacent or outside of the connector body 729.

In an embodiment, either or both of the pistons 725, 745 may be disposed in the connector body 729. When a transverse option is desired, one or more of the pistons 745 may be provided within the same connector body 729. Although not illustrated in FIG. 7, fluid passages may be provided within the connector body 729 to port the fluid of either inner chamber 739, 759 to a location between seals 761. Seals 761 provide sealing between the connector body 729 and a tubular body 765 similar to the seals 257 illustrated in FIGS. 2-5. Seals 761 prevent ingress of fluid from outside the connector body 729 into the inner chamber 739, 759.

Figure 8:
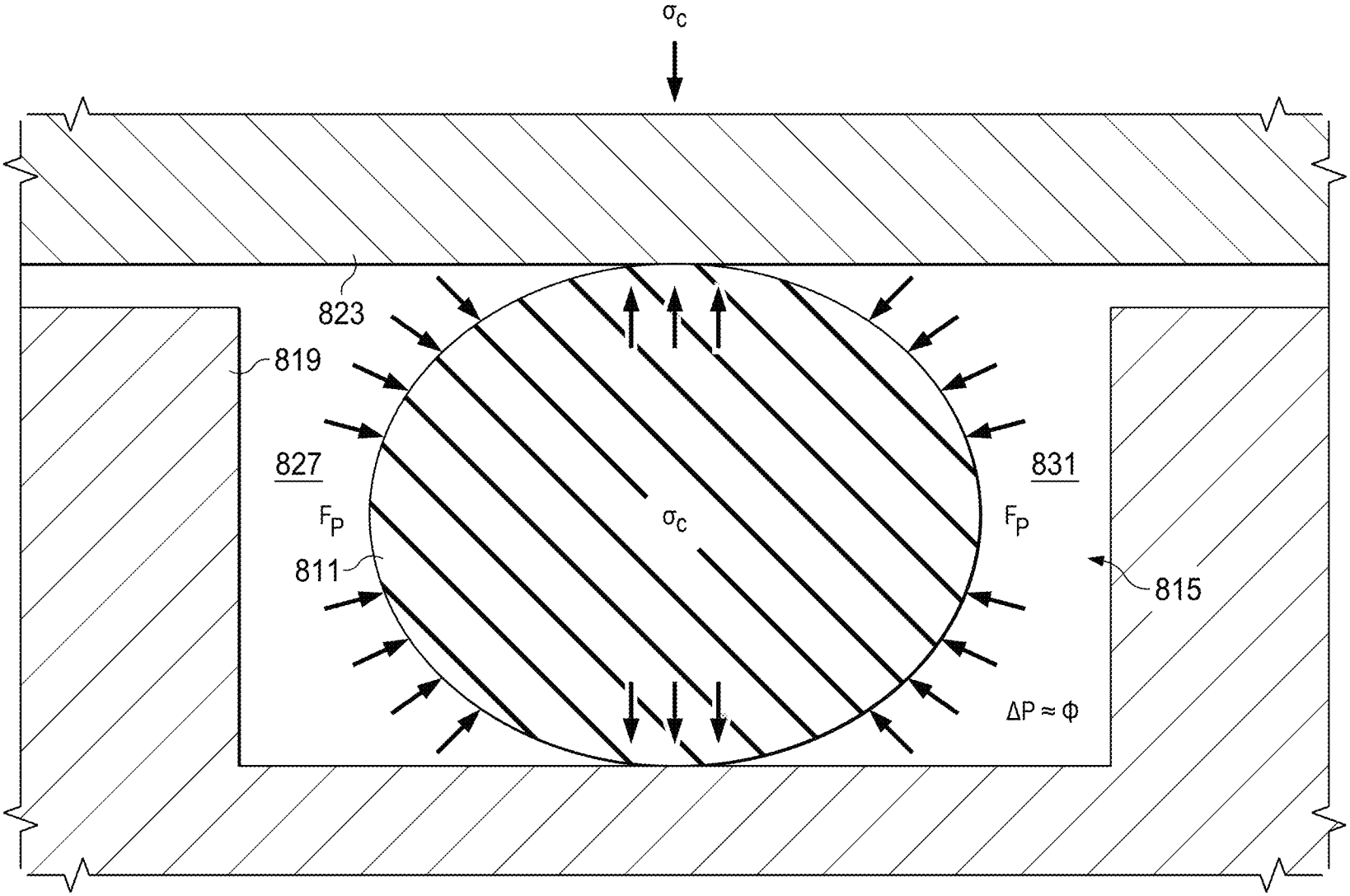
FIG. 8 is a schematic of a seal within a seal recess, the seal shown in an un-energized state.
Figure 9:
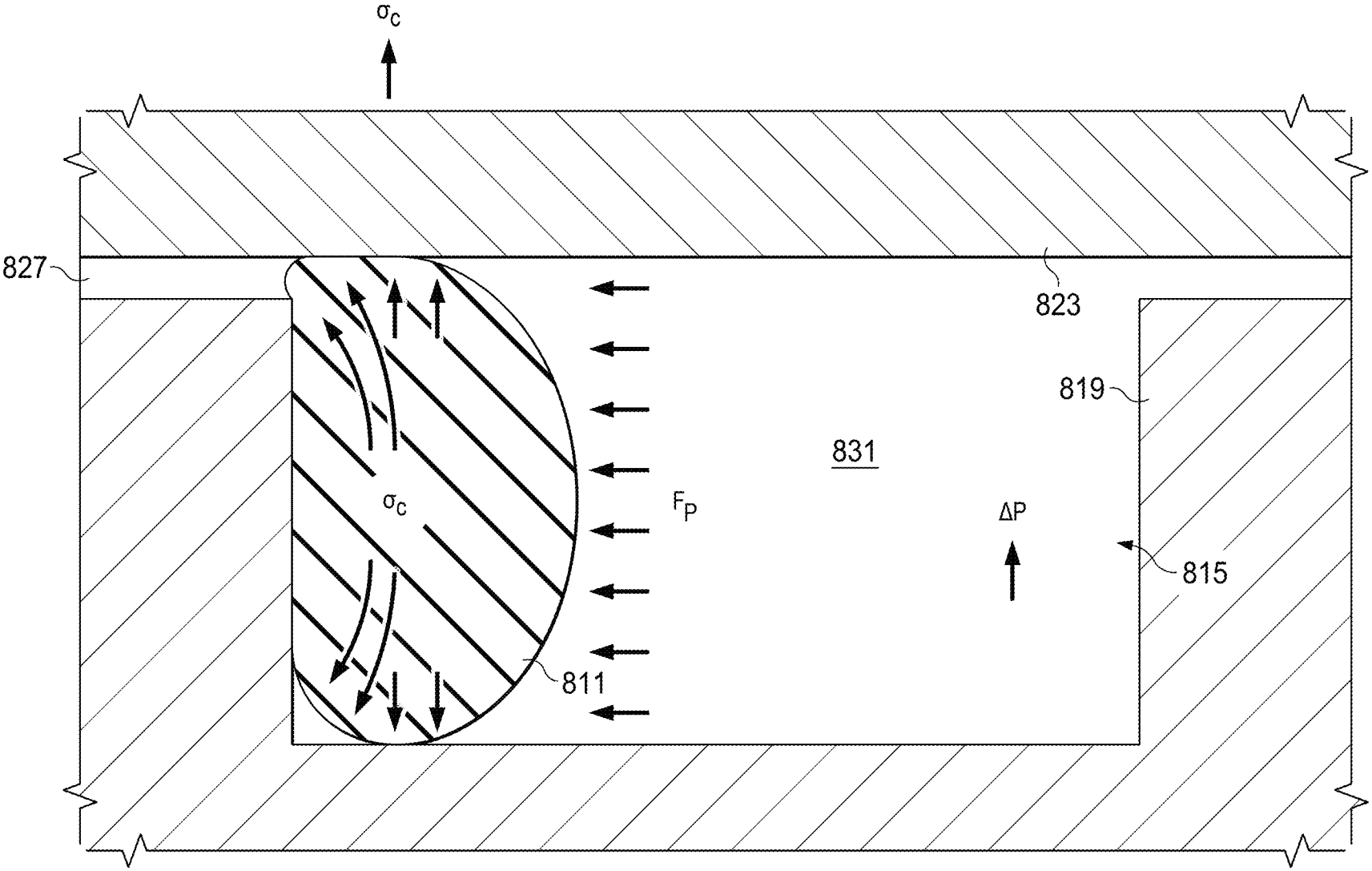
FIG. 9 is a schematic of a seal within a seal recess, the seal shown in an energized state.

Referring to FIGS. 8 and 9, a schematic of a seal 811 positioned within a recess 815 of a connector body 819. The seal 811 provides sealing between the connector body 819 and a tubular body 823, thereby preventing migration of fluid from a first chamber 827 into a second chamber 831. The diameter (or width) of the seal 811 may be greater than the depth of the recess 815, thereby causing the seal 811 to exert a force on both the connector body 819 and the tubular body 823 when the connector body 819 and the tubular body 823 are brought into close proximity. In FIG. 8, the forces, $F_P$, on each side of the seal are approximately equal to one another due to the pressure of the fluid in first chamber 827 being approximately equal to the pressure of the fluid in second chamber 831. This balanced-pressure scenario reduces the sealing capabilities of the seal 811 since the contact area between the seal 811 and either of the connector body 819 and the tubular body 823 is fairly small. Such a small contact area, results in an increased likelihood that fluid migration will occur between the first chamber 827 and the second chamber 831. In FIG. 9, the seal 811 is "energized" by the pressure differential of the fluids in the two chambers. More specifically, the pressure of fluid in second chamber 831 is greater than the pressure of fluid in first chamber 827. This pressure differential results in a higher force, Fp, on one side of the seal 811 than the other, which deforms the seal 811 and moves the seal 811 into contact with a wall of the recess 815. This energization of the seal 811 greatly increases the contact area between the seal 811 and the connector body 819 and the tubular body 823, as demonstrated in FIG. 9.

The balanced-pressure situation shown in FIG. 8 is emblematic of the issues encountered in downhole balanced-pressure systems when trying to prevent ingress of wellbore or other fluids into an isolated space such as the inner chambers described herein. The pistons provided in the seal energization systems 221, 621, 721 provide a way to ensure that the pressure of fluid in the inner (or isolated) chamber consistently remains above the pressure of fluids that are external to the inner chamber. This creates the needed pressure differential to energize and deform the seal as shown in FIG. 9, which improves sealing and significantly reduces the likelihood of fluid migration into the inner chamber.

It is essential to prevent migration of fluids into an isolated chamber, especially when the fluids within and outside the chamber are different fluids. Examples include the use of a dielectric fluid in an isolated chamber to improve the electrical conductivity of an electrical connection that is made within the chamber. Ingress of fluids from outside the chamber, such as wellbore fluids, may destroy the dielectric properties of the fluid in the chamber, thereby degrading the quality of the electrical connection and the ability to maintain a suitable voltage. Another example may include the use of a non-corrosive fluid within an isolated chamber to prevent corrosion on a part or component housed within the chamber. For instance, a high strength steel spring may be positioned in a chamber, and the material chosen for the spring may be significantly cheaper if the material is not required to be highly resistant to corrosion. Surrounding the part in the chamber with a non-corrosive fluid would allow the use of the cheaper material, but it would be desired to block the ingress of corrosive wellbore fluids into the chamber. The seal energization systems and methods described herein increase the ability of seals to protect an isolated chamber.

In addition to the embodiments and examples of a seal energizing systems and methods provided above, the following are additional illustrative examples.

Example 1. A seal energizing system to maintain seal energization in a well, the system comprising a connector body disposed adjacent a tubular body, the tubular body and connector body forming an inner chamber, the inner chamber isolated from an outer chamber by a seal positioned between the tubular body and the connector body; and a piston movable relative to the connector body, the piston have a first piston surface exposed to a fluid of the outer chamber and a second piston surface exposed to fluid of the inner chamber, the first piston surface having a surface area greater than that of the second piston surface.

Example 2. The system of example 1, wherein the fluid of the outer chamber is a wellbore fluid.

Example 3. The system of examples 1 or 2, wherein the fluid of the inner chamber is a dielectric fluid.

Example 4. The system of any of examples 1-3, wherein the fluid of the inner chamber is maintained at a higher pressure than the fluid of the outer chamber.

Example 5. The system of any of examples 1-4, wherein an electrical connection is maintained within the fluid of the internal chamber.

Example 6. The system of any of examples 1-5, further comprising a second piston movable relative to the connector body, the piston having a first piston surface exposed to a fluid of the outer chamber and a second piston surface exposed to fluid of the inner chamber, the first piston surface of the second piston having a surface area greater than that of the second piston surface of the second piston.

Example 7. The system of any of examples 1-6, wherein the connector body is received within the tubular body.

Example 8. The system of example 7 further comprising an inner tubular, the connector body positioned between the tubular body and the inner tubular.

Example 9. A method to maintain seal energization in a downhole balanced pressure system, the method comprising providing a piston movable between a first chamber and a second chamber, the piston having a first surface area in contact with a first fluid in the first chamber and a second surface area in contact with a second fluid in the second chamber, the second surface area being smaller than the first surface area; exerting a first force with the first fluid on the first surface area of the piston to increase the pressure of the second fluid relative to the first fluid; and deforming a seal with the increased pressure of the second fluid to provide sealing between the first chamber and the second chamber.

Example 10. The method of example 9, wherein the first fluid is a wellbore fluid.

Example 11. The method of examples 9 or 10, wherein the second fluid is a dielectric fluid.

Example 12. The method of any of examples 9-11 further comprising maintaining an electrical connection in the second chamber.

Example 13. The method of any of examples 9-12, wherein deforming a seal further comprises exerting a higher force against the seal with the second fluid than with the first fluid to cause sealing engagement between the seal and a sealing surface.

Example 14. The method of any of examples 9-13, wherein the second chamber is created between a casing tubular and a connector body.

Example 15. The method of any of examples 9-14, wherein the first chamber is a wellbore.

Example 16. A seal energizing system to maintain seal energization in a well, the system comprising a tubular body; an inner tubular positioned within a passage of the tubular body; a connector body disposed within a tubular annulus formed between the tubular body and the inner tubular, the connector body having an outer body member and an inner body member, the outer body member having a recessed portion; an inner chamber formed between the recessed portion of the outer body member and the tubular body; a seal positioned between the outer body member and the tubular body to seal the inner chamber from the tubular annulus; and a piston slidingly positioned with a connector annulus formed between the outer body member and the inner body member, the piston having a first piston surface exposed to a fluid of the tubular annulus and a second piston surface exposed to fluid of the inner chamber, the first piston surface having a surface area greater than that of the second piston surface.

Example 17. The system of example 16 further comprising an aperture formed in the outer body member to provide fluid communication between the second piston surface and the inner chamber.

Example 18. The system of examples 16 or 17 further comprising a seal recess circumferentially disposed in the outer body member to receive the seal.

Example 19. The system of any of examples 16-18 further comprising a first fluid in the tubular annulus; and a second fluid in the inner chamber.

Example 20. The system of example 19, wherein the first fluid is a wellbore fluid, and the second fluid is a dielectric fluid.

Although the present disclosure and its advantages have been described in detail, it should be understood that various changes, substitutions and alterations can be made herein without departing from the spirit and scope of the disclosure as defined by the following claims.

What is claimed is:

1. A method to maintain seal energization in a downhole system, the method comprising:

providing the downhole system; wherein the downhole system comprises:

a tubular body;

an inner tubular positioned within a passage of the tubular body;

a connector body disposed within a tubular annulus formed between the tubular body and the inner tubular, the connector body having an outer body member and an inner body member, the outer body member having a recessed portion;

an inner chamber formed between the recessed portion of the outer body member and the tubular body;

a seal positioned between the outer body member and the tubular body to seal the inner chamber from the tubular annulus; and a piston slidingly positioned within a connector annulus formed between the outer body member and the inner body member, the piston having a first piston surface area exposed to a first fluid of the tubular annulus and a second piston surface area exposed to a second fluid of the inner chamber, the first piston surface area having a surface area greater than that of the second piston surface area;

exerting a first force with the first fluid on the first piston surface area to increase the pressure of the second fluid relative to the first fluid; and deforming the seal with the increased pressure of the second fluid to provide sealing between the inner chamber from the tubular annulus.

2. The method of claim 1, wherein the first fluid is a wellbore fluid.

3. The method of claim 1, wherein the second fluid is a dielectric fluid.

4. The method of claim 1 further comprising:

maintaining an electrical connection in the inner chamber.

5. The method of claim 1, wherein deforming the seal further comprises:

exerting a higher force against the seal with the second fluid than with the first fluid to cause sealing engagement between the seal and a sealing surface.

6. The method of claim 1, wherein the connector body is shorter than the tubular body.

7. The method of claim 1, wherein the second fluid in the inner chamber is maintained at a higher pressure than the first fluid in the tubular annulus.

8. The method of claim 1, wherein the piston includes a shoulder that is capable of engaging a corresponding shoulder on the connector body.

9. The method of claim 1, wherein the second fluid is silicone oil.

10. The method of claim 1, wherein the second fluid is a dielectric gel.

11. A seal energizing system to maintain seal energization in a well, the system comprising:

a tubular body;

an inner tubular positioned within a passage of the tubular body;

a connector body disposed within a tubular annulus formed between the tubular body and the inner tubular, the connector body having an outer body member and an inner body member, the outer body member having a recessed portion;

an inner chamber formed between the recessed portion of the outer body member and the tubular body;

a seal positioned between the outer body member and the tubular body to seal the inner chamber from the tubular annulus; and a piston slidingly positioned within a connector annulus formed between the outer body member and the inner body member, the piston having a first piston surface exposed to a fluid of the tubular annulus and a second piston surface exposed to fluid of the inner chamber, the first piston surface having a surface area greater than that of the second piston surface.

12. The system of claim 11 further comprising:

an aperture formed in the outer body member to provide fluid communication between the second piston surface and the inner chamber.

13. The system of claim 11 further comprising:

a seal recess circumferentially disposed in the outer body member to receive the seal.

14. The system of claim 11 further comprising:

a first fluid in the tubular annulus; and a second fluid in the inner chamber.

15. The system of claim 14, wherein the first fluid is a wellbore fluid, and the second fluid is a dielectric fluid.

16. The system of claim 11, wherein the connector body is shorter than the tubular body.

17. The system of claim 11, wherein an electrical connection is maintained in the inner chamber.

18. The system of claim 14, wherein the second fluid in the inner chamber is maintained at a higher pressure than the first fluid in the tubular annulus.

19. The system of claim 11, wherein the piston includes a shoulder that is capable of engaging a corresponding shoulder on the connector body.

20. The system of claim 11, wherein the fluid in the inner chamber is silicone oil.

* * * * *